US010660428B2

(12) United States Patent
Moreau et al.

(10) Patent No.: US 10,660,428 B2
(45) Date of Patent: May 26, 2020

(54) SMALL PARTS POUCH WITH SELF-SEALING CLOSURE

(71) Applicant: Pure Safety Group, Inc., Pasadena, TX (US)

(72) Inventors: Darrell A. Moreau, Portsmouth, NH (US); Andre W. Moreau, Deerfield, NH (US)

(73) Assignee: Pure Safety Group, Inc., Pasadena, TX (US)

( * ) Notice: Subject to any disclaimer, the term of this patent is extended or adjusted under 35 U.S.C. 154(b) by 261 days.

(21) Appl. No.: 13/709,096

(22) Filed: Dec. 10, 2012

(65) Prior Publication Data

US 2014/0161371 A1 Jun. 12, 2014

(51) Int. Cl.
*B65D 33/16* (2006.01)
*A45F 5/02* (2006.01)
*A45C 13/10* (2006.01)

(52) U.S. Cl.
CPC ..... *A45F 5/021* (2013.01); *A45C 13/10* (2013.01); *B65D 33/16* (2013.01)

(58) Field of Classification Search
CPC .... A45F 5/02; A45F 5/021; A45F 2200/0575; B65D 33/1616; B65D 33/30; B65D 33/16; A45C 2013/1007; A45C 13/06
USPC ..... 383/33, 35, 36, 42, 43, 50, 68, 71, 93, 383/95, 907, 44, 46–49, 54, 56, 57, 901; 224/904; 150/150, 900; 4/144.1, 144.2; 604/323, 350
See application file for complete search history.

(56) References Cited

U.S. PATENT DOCUMENTS

| | | | | |
|---|---|---|---|---|
| 1,658,294 | A * | 2/1928 | Lewis | 150/150 |
| 4,241,865 | A | 12/1980 | Ferrell | |
| 4,317,478 | A | 3/1982 | Babbidge | |
| 4,756,628 | A | 7/1988 | Branson | |
| 5,037,138 | A * | 8/1991 | McClintock | B65D 33/24 383/210 |
| 5,176,452 | A | 1/1993 | Stern | |
| 6,022,144 | A * | 2/2000 | Hausslein | 383/33 |
| 6,361,210 | B2 | 3/2002 | Denko | |
| 6,371,642 | B1 | 4/2002 | Nelson et al. | |
| 6,457,863 | B1 | 10/2002 | Vassallo | |
| 6,612,741 | B1 | 9/2003 | Horne | |
| 7,014,363 | B2 * | 3/2006 | Hanson | B65D 31/10 383/10 |

(Continued)

*Primary Examiner* — Jes F Pascua
*Assistant Examiner* — Nina K Attel
(74) *Attorney, Agent, or Firm* — Dicke, Billig & Czaja, PLLC

(57) ABSTRACT

A self-closing utility bag for holding small articles includes a pouch with an upper pouch portion, a lower pouch portion, a neck portion between the upper and lower pouch portions, a top opening that is maintained in a partially open orientation, and a self-closing mechanism. The self-closing mechanism includes a first resilient strip disposed parallel to a pouch top opening at a location either adjacent the neck portion in the upper pouch portion but spaced from the pouch top opening or at the neck portion, and a second resilient strip disposed opposite the first resilient strip where the first and second resilient strips maintain the pouch in a closed orientation but having a resilient spring action that allows intruding access to an inside of the lower portion while returning to the closed orientation when the intruding access is removed.

22 Claims, 6 Drawing Sheets

(56) References Cited

U.S. PATENT DOCUMENTS

| | | | | |
|---|---|---|---|---|
| 2001/0005973 | A1 | 7/2001 | Schneider et al. | |
| 2001/0026650 | A1 | 10/2001 | Denko | |
| 2003/0031386 | A1 | 2/2003 | Shepard et al. | |
| 2007/0094850 | A1 | 5/2007 | Hui | |
| 2008/0120945 | A1 | 5/2008 | Holbrook et al. | |
| 2008/0185414 | A1* | 8/2008 | Conlon | 224/674 |
| 2009/0266036 | A1* | 10/2009 | Zerfas | B65B 9/087 53/469 |
| 2011/0052106 | A1* | 3/2011 | Holmes et al. | 383/119 |
| 2012/0057809 | A1 | 3/2012 | Buller et al. | |
| 2012/0170873 | A1 | 7/2012 | Matthews | |

* cited by examiner

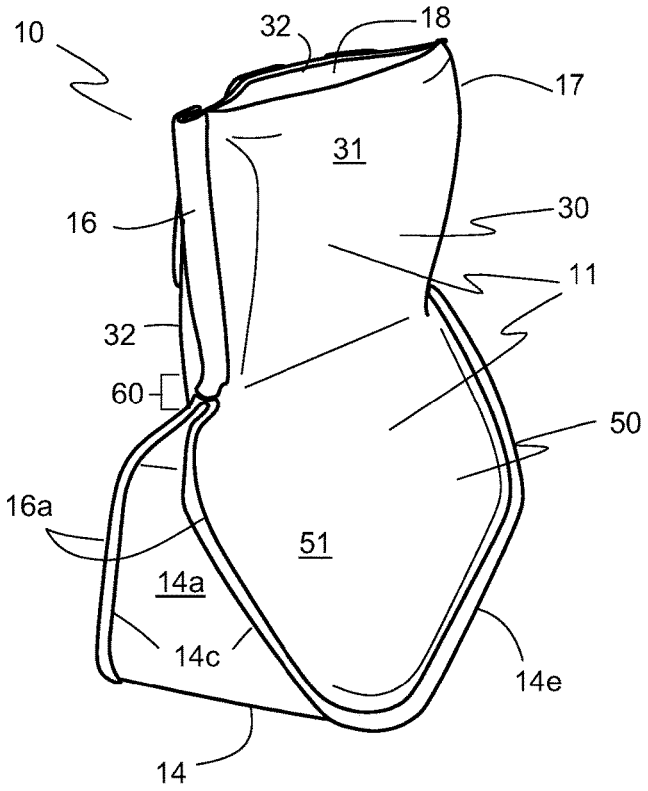
Fig. 1
Fig. 2
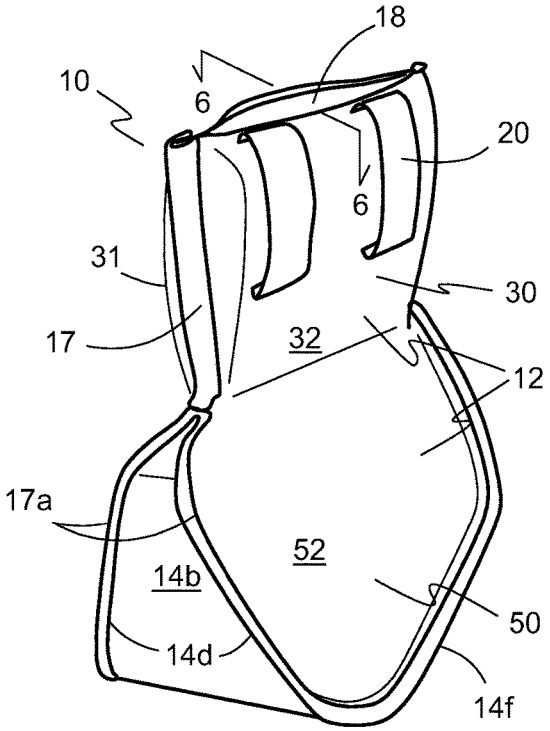
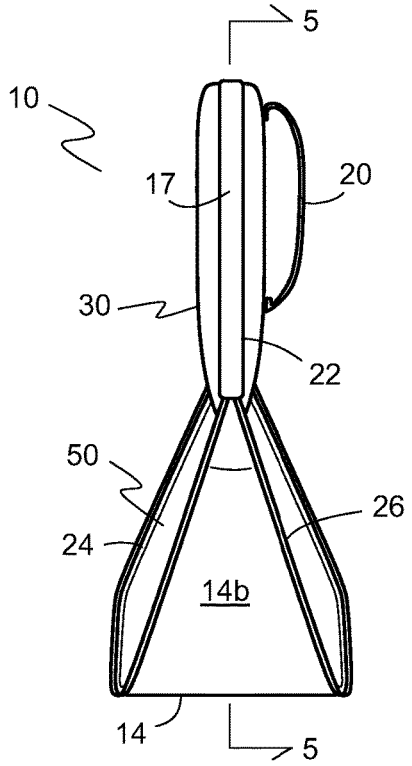
Fig. 3

SMALL PARTS POUCH WITH SELF-SEALING CLOSURE

BACKGROUND OF THE INVENTION

1. Field of the Invention

The present invention relates generally to small parts bags and/or pouches. Particularly, the present invention relates to a small parts pouch with self-sealing closure.

2. Description of the Prior Art

There exist a large variety pouches and aprons used by workers such as construction workers, maintenance workers, carpenters, framers, and iron workers. Typically, these pouches and/or aprons are made from materials such as cotton, nylon, leather, vinyl, and the like. Each tool pouch/apron includes one or more pouches adapted for receiving a plurality of small parts, nails, screws, and other similarly sized components that are required by workers for performing their duties. In these types of aprons, the pouches have open tops to allow easy access by the worker needing one of the small parts such as a fastener. The open tops may, at times, allow the parts and/or fasteners contained in the pouch to fall out depending on the worker's movement and orientation. Oftentimes, a worker will retrieve a plurality of parts and/or fasteners for use and, in so doing, inadvertently spills or drops some of the parts and/or fasteners to the ground caused by the simple act of removing the worker's hand from the pouch.

To alleviate this concern, there have been devised pouches that are self-closing. These include a waterproof case that is opened by pressure on two opposite points. Another is a self-closing, snap-open pouch that has opposed transverse creases adjacent the ends of each closure strip to insure that the strips will spring apart under a longitudinal compressive load applied to both strips at the ends.

There is also disclosed a utility pouch having a self-sealing closure. The pouch includes a body that defines an interior space in which items can be stored, an opening that provides access to the interior space, and a self-sealing closure associated with the opening that prevents items from falling out of the pouch. The opening includes a cylindrical cord that encircles the opening. The closure has two opposed pieces of resilient material such as rubber, neoprene and the like that together seal the interior space of the pouch. The closure forms a generally V-shaped cross-section secured within the opening such that the top edges of the opposed resilient pieces are separated and their bottom edges contact each other in their natural state.

SUMMARY OF THE INVENTION

The prior art suffers from various disadvantages. In those self-closing bags/pouches that require a longitudinal compressive force at the ends of the self-closing strips, two hands are required. One to apply the longitudinal compressive force to open and maintain the bag/pouch in an open orientation and a second hand to retrieve and/or place small items within the interior space of the bag/pouch. In the self-closing bag/pouch that have a neoprene/rubber closure forming a generally V-shaped cross-section secured within the bag/pouch opening such that the top edges of the opposed resilient pieces of the closure are separated and their bottom edges contact each other in their natural state, the pouch must have a deeper/higher configuration from the open top to the bottom of the internal space to accommodate the neoprene/rubber closure in order to maintain the bottom edges in contact with each other in the natural state.

It is an object of the present invention to provide a self-closing utility bag for small parts that permits opening and access to the internal volume or space using one hand. It is another object of the present invention to provide a self-closing utility bag for small parts that includes a self-closing mechanism recessed from an open top of the pouch.

The present invention achieves these and other objectives by providing a self-closing utility bag for small parts that has an upper pouch portion with a top opening, a lower pouch portion and a neck portion between the upper pouch portion and the lower pouch portion where the upper and neck portions provide access to the internal space of the lower pouch portion. A self-closing mechanism is spaced from the top opening and attached within either the upper pouch portion or the neck portion.

In one embodiment of the present invention, the self-closing utility bag for holding small articles includes a pouch with an upper pouch portion, a lower pouch portion, a neck portion between the upper and lower pouch portions, a pouch top opening, and a first resilient strip and a second resilient strip opposed to the first resilient strip where the first and second resilient strips are attached to the upper pouch portion and spaced from the top opening. The upper pouch portion has a first upper pouch wall and a second upper pouch wall. The lower pouch portion has a first lower pouch wall and a second lower pouch wall. The neck portion is formed between a pouch first side edge, a pouch second side edge and the pouch top opening. The pouch top opening has a size sufficient to allow a user's hand to pass into and out of the upper pouch portion. The first upper pouch wall and the second upper pouch wall are configured to maintain the pouch top opening in a partially open orientation. The self-closing mechanism includes a first resilient strip and a second resilient strip opposed to the first resilient strip. The first and second resilient strips are disposed substantially parallel to the pouch top opening and at a location that is adjacent the neck portion in the upper pouch portion but spaced from the pouch top opening or at the neck portion. The first and second resilient strips maintain the pouch at or adjacent the neck portion in a closed orientation but have a resilient spring action that allows intrusive access to the internal volume/space while returning to the closed orientation when the intrusive access is removed.

In another embodiment of the present invention, the neck portion is formed by the pouch first side edge and the pouch second side edge converging towards each other from the pouch top opening to the neck portion and diverging away from each other toward the lower pouch portion.

In a further embodiment of the present invention, the neck portion forms a secondary opening within the bag and below the pouch top opening where the secondary opening has a size sufficient to allow passage of a user's hand into and out of the lower pouch of the bag.

In still another embodiment of the present invention, a protective liner is disposed on and attached to at least a portion of the inside surface of the pouch lower portion.

In yet another embodiment of the present invention, the first resilient strip is disposed with a hem formed on an inside surface of the first upper pouch wall of the upper pouch portion.

In another embodiment of the present invention, the second resilient strip is disposed within a hem formed on the inside surface of a second upper pouch wall of the upper pouch portion.

In a further embodiment of the present invention, the first and second resilient strips extend over a substantial distance between the pouch first side edge and the pouch second side edge.

In another embodiment of the present invention, the bag includes a bottom or bottom panel in the lower pouch portion between the first lower pouch wall and the second lower pouch wall at a first bottom edge and a second bottom edge of the first and second lower pouch walls.

In still another embodiment of the present invention, the bag includes at least one belt loop attached to the upper portion on an outside surface of the pouch.

BRIEF DESCRIPTION OF THE DRAWINGS

FIG. 1 is a front perspective view of one embodiment of the present invention showing a self-closing pouch for small parts.

FIG. 2 is a rear perspective view of the embodiment of the present invention shown in FIG. 1.

FIG. 3 is an end view of the embodiment shown in FIG. 1.

DETAILED DESCRIPTION OF THE PREFERRED EMBODIMENT

Figure 4:
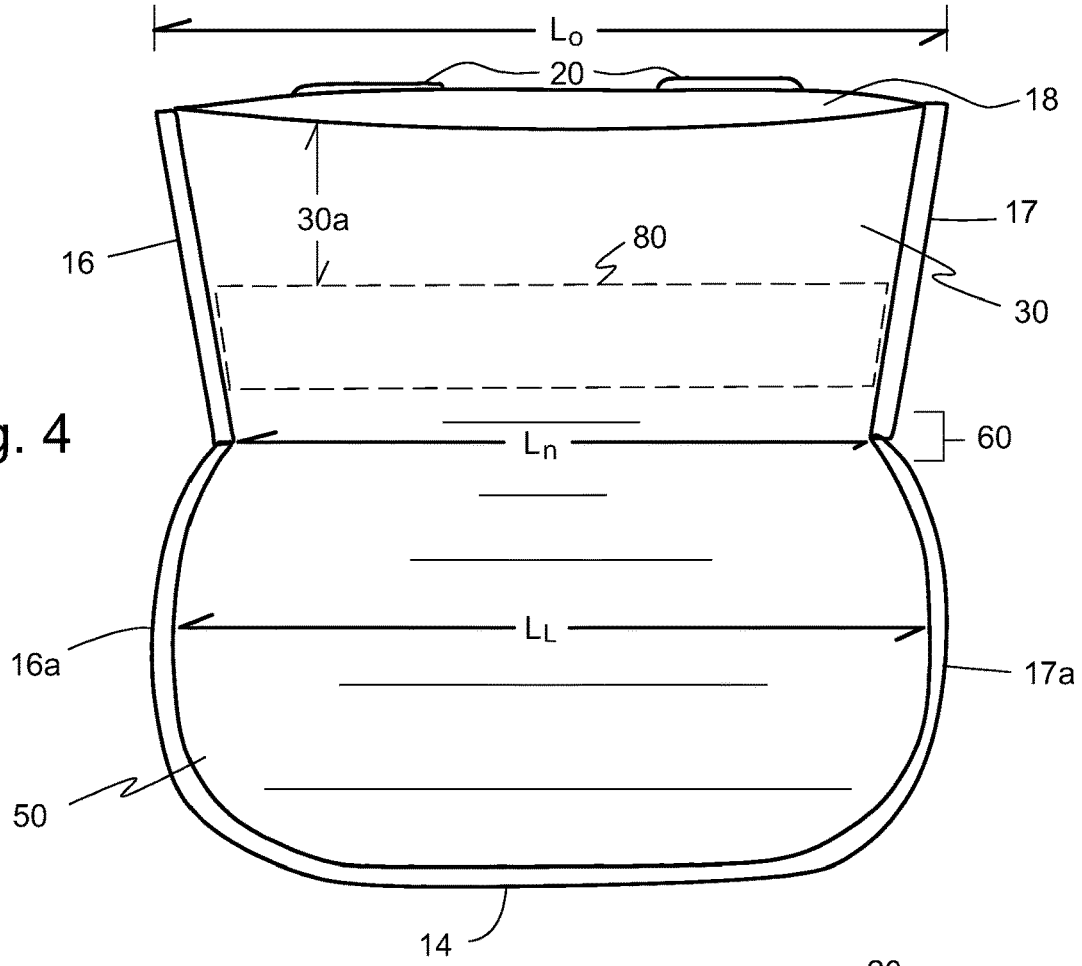
FIG. 4 is a side view of the embodiment shown in FIG. 1 showing the preferred position of the self-closing mechanism.

The preferred embodiments of the present invention are illustrated in FIGS. 1-11. FIGS. 1 and 2 show one embodiment of a small parts pouch 10 with a self-sealing closure (shown in FIGS. 4-11). Pouch 10 includes an upper pouch portion 30, a lower pouch portion 50, a pouch bottom 14, a first upper pouch edge 16, a second upper pouch edge 17, and a pouch top opening 18. Upper pouch portion 30 has a first upper wall 31 and a second upper wall 32. Lower pouch portion 50 has a first lower wall 51 and a second lower wall 52. Upper pouch portion 30 is connected to lower pouch portion 50 at a pouch neck portion 60. First upper wall 31 and first lower wall 51 form pouch front wall 11. Second upper wall 32 and second lower wall 52 form pouch rear wall 12. Lower pouch portion 50 defines a pouch volume or internal space 70 (shown in FIGS. 5-6). Pouch volume 70 is configured to receive small parts such as, for example, screws, nails, nuts and bolts, rivets, washers, spacers, and the like. Pouch 10 may be made of polyurethane, polyvinyl chloride, nylon, polyester, canvas, and the like. A vinyl coated polyester is preferred for ease of cleaning.

Bottom 14 extends upward to neck portion 60 at opposed first upper pouch edge 16 and second upper pouch edge 17 forming lower first edge wall 14*a* and lower second edge wall 14*b*. In this embodiment, pouch volume 70 is formed by bonding the peripheral edges 14*c*, 14*d*, 14*e*, and 14*f* of bottom 14, first edge wall 14*a* and second edge wall 14*b* to the peripheral edges 16*a*, 17*a* of first lower wall 51 and second lower wall 52, respectively. The peripheral edges may be adhered to each other using adhesives, stitching, hemming, or other means known to those skilled in the art. To facilitate carrying pouch 10, at least one belt loop 20 is fixedly attached to the upper pouch portion 30 on pouch rear wall 12. Although a single, wider belt loop 20 may be used, two or more belt loops 20 are preferred.

FIG. 3 illustrates a side view of pouch 10. To provide pouch 10 with a more aesthetically pleasing appearance, an upper hem 22 is fixedly attached on each of first upper pouch edge 16 and second upper pouch edge 17. A lower front hem 24 and a lower rear hem 26 are fixedly attached on each of the peripheral edges 14*c*, 14*d*, 14*e*, 14*f*, 16*a*, and 17*a*.

Turning now to FIG. 4, there is illustrated a front view of pouch 10. As shown, neck portion 60 has a length $L_n$ that is shorter than length $L_o$ between first pouch edge 16 and second pouch edge 17 at pouch top opening 18 and shorter than length $L_L$ between first pouch edge 16*a* and second pouch edge 17*a* of lower portion 50. Although pouch 10 may be made in a variety of sizes, the preferred size has a length $L_L$ of about 9-9.5 inches, a length $L_o$ of about 8.75-9.25 inches and a length $L_n$ of about 7.5-8 inches. Although it is preferable and shown that first pouch edge 16 and second pouch edge 17 converge towards each other at neck portion 60, the edges 16, 17 may be parallel or diverge from each other.

Also shown is a self-closing mechanism 80 located within upper portion 30 of pouch 10. Self-closing mechanism 80 is spaced a predefined distance below pouch opening 18. Preferably, mechanism 80 is in the range of about 1.5 inches to 2.5 inches below pouch opening 18 and is made of two strips of resilient material such as metal, thermoplastic, and the like opposed to each other where one of the two strips is attached to each of the first upper wall 31 and second upper wall 32.

An important aspect of first upper wall 31 and second upper wall 32 is that there is excess material between first pouch edge 16 and second pouch edge 17 at least above self-closing mechanism 80 in an area designated by reference number 30*a* while the material to which self-closing mechanism 80 is attached does not have excess material between first pouch edge 16 and second pouch edge 17. It is the excess material that enables pouch top opening 18 to remain slightly open to provide easy access by a user's hand to the self-closing mechanism 80. There are various ways to provide the required relationship between self-closing mechanism 80 and a slightly open pouch top 18. One is disclosed in relation to FIG. 6 below.

Figure 5:
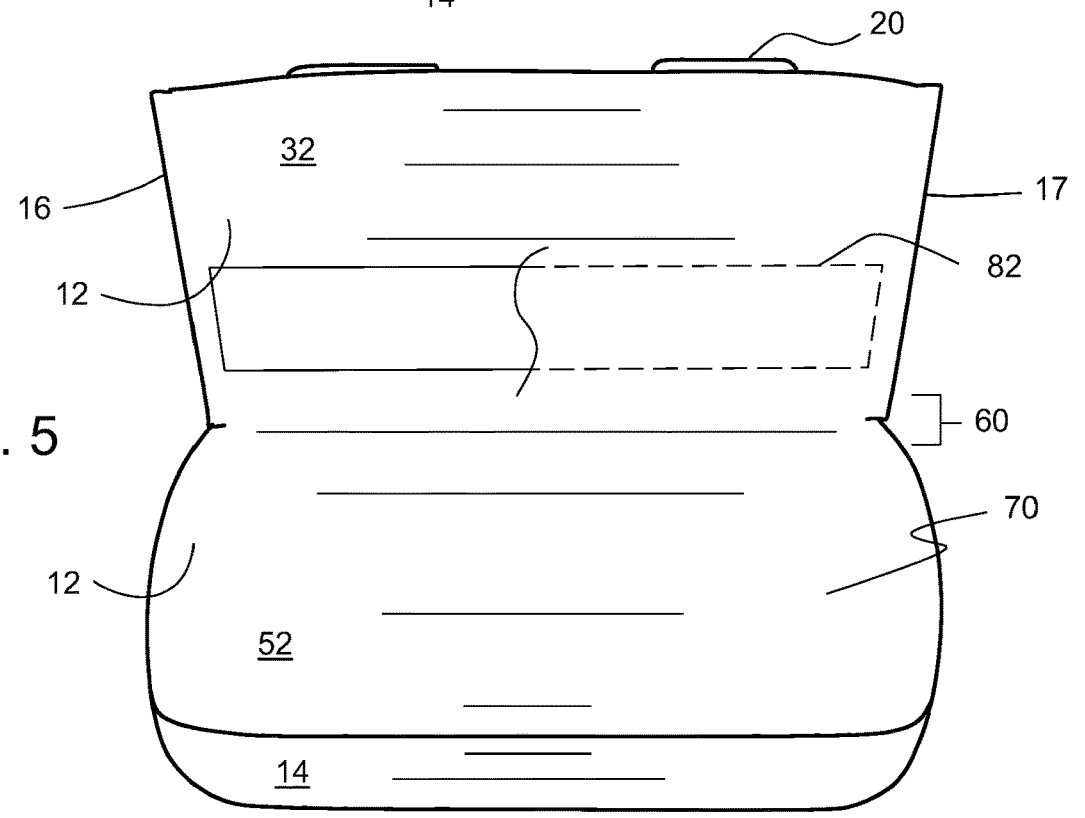
FIG. 5 is a cross-sectional view of the self-closing pouch taken along line 5 in FIG. 3.

FIG. 5 is a cross-sectional view of pouch 10 showing the inside of pouch rear wall 12 and a partial segment of bottom 14. Attached to second upper wall 32 is second closing strip 82. Second closing strip 82 may be attached using adhesives, stitching, hemming and the like. It is preferred that first and second upper walls 31, 32 fold upon themselves at pouch top opening 18 to present a soft, pliable surface for a user's hand to prevent scratching, scrapping and/or cutting the skin on the user's fingers when entering pouch 10. One embodiment of this folding is more clearly shown in FIG. 6.

Figure 6:
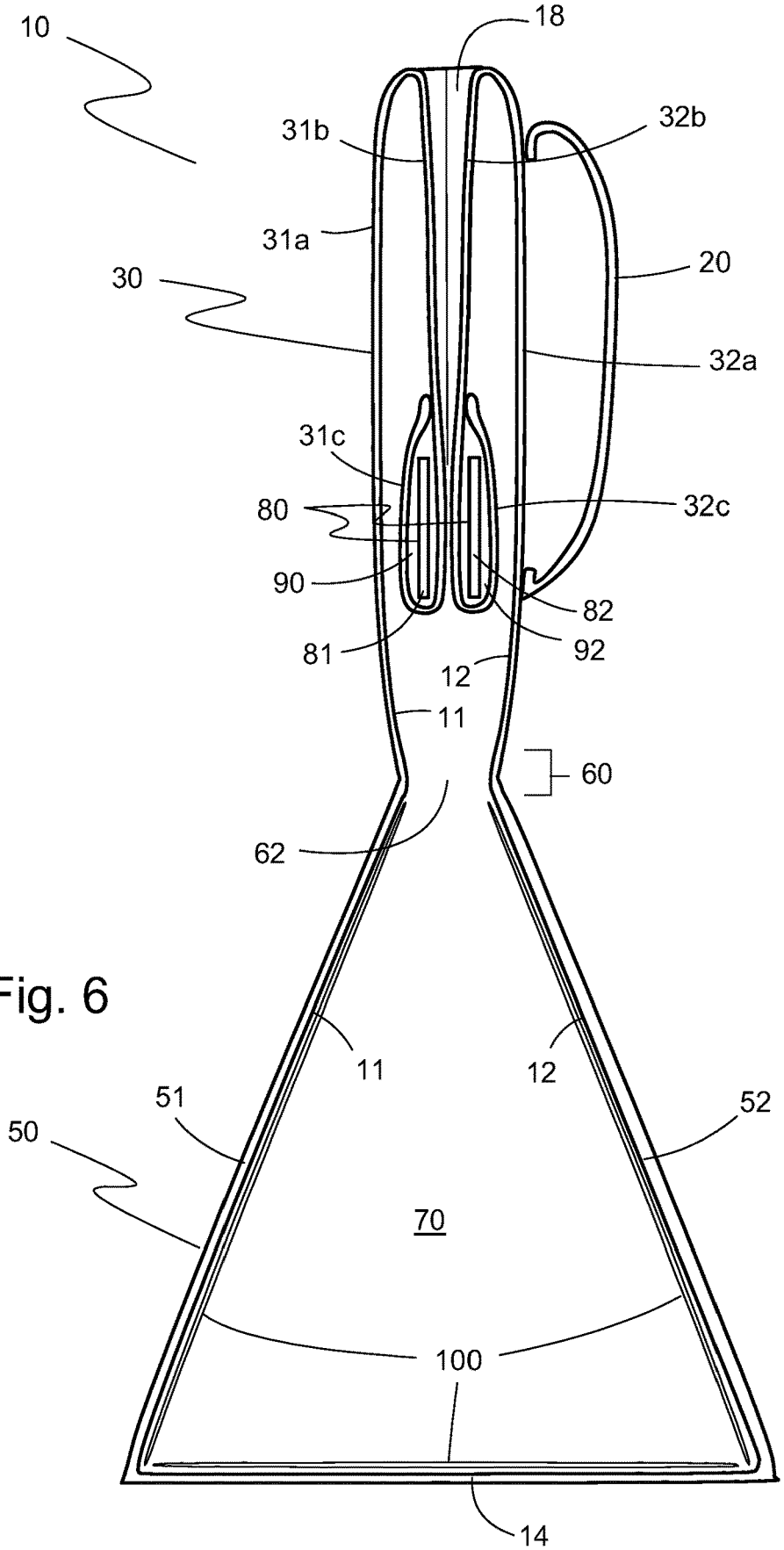
FIG. 6 is a cross-sectional view of the self-closing pouch taken along line 6 in FIG. 2.
Figure 7:
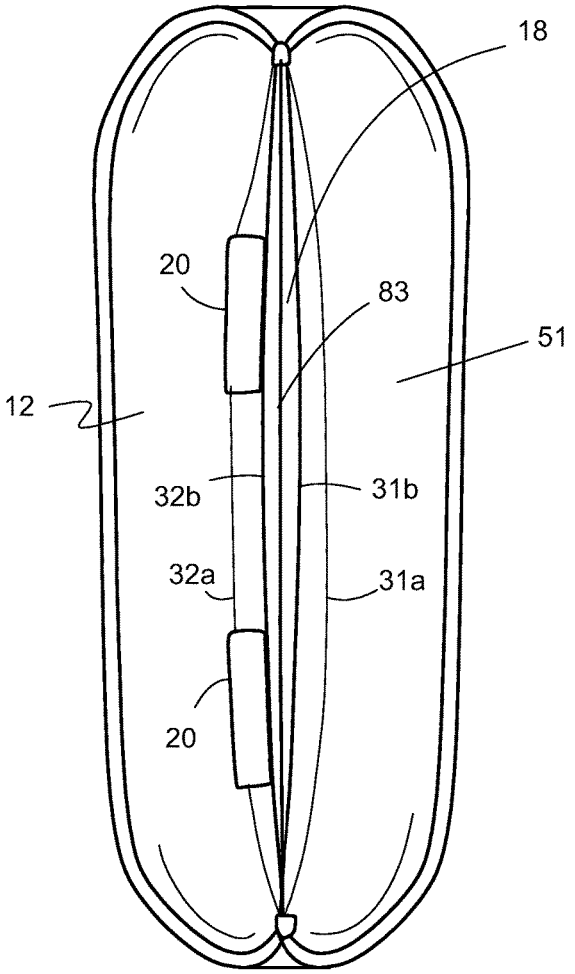
FIG. 7 is a top view of the embodiment shown in FIG. 1 showing the self-closing mechanism in a normally-closed position.
Figure 8:
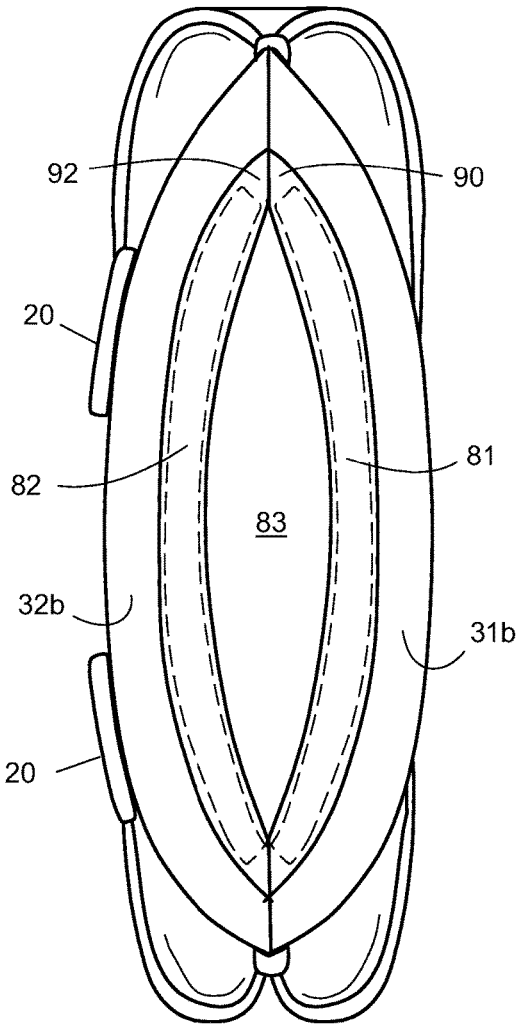
FIG. 8 is a top view of the embodiment shown in FIG. 1 showing the self-closing mechanism in a position when a user's hand is accessing the internal chamber of the pouch.

Turning now to FIG. 6, there is illustrated a cross-sectional view of pouch 10 transverse to pouch front wall 11 and pouch rear wall 12. As is more clearly shown, first lower wall 51, second lower wall 52 and bottom 14 of pouch lower portion 50 defines pouch volume 70 in which small parts are contained. First lower wall 51 and second lower wall 52 converge towards each other from bottom 14 to neck portion 60 defining a neck opening 62. First upper wall 31 and second upper wall 31 extend upwardly from neck opening 62 at a relatively smaller divergent angle. In this embodiment, first upper wall 31 has a first upper outside wall 31*a* and a first upper inside wall 31*b*. As shown, first upper outside wall 31*a* folds in a reverse direction at pouch top opening 18 forming first inside wall 31*b* that extends toward neck opening 62. At a predefined distance below and from pouch top opening 18, first inside wall 31*b* again folds in a reverse direction forming a first hem wall 31*c*. First hem wall 31*c* extends a predefined distance towards pouch top opening 18 to form a hem enclosure 90 for receiving and securing a first closing strip 81 of closing mechanism 80. Likewise, second upper wall 32 has a second upper outside wall 32*a* and a second upper inside wall 32*b*. As shown, second upper outside wall 32*a* folds in a reverse direction at pouch top opening 18 forming second inside wall 32*b* that extends toward neck opening 62. At a predefined distance below and from pouch top opening 18, second inside wall 32*b* again folds in a reverse direction forming a second hem wall 32*c*. Second hem wall 32*c* extends a predefined distance towards pouch top opening 18 to form a hem enclosure 92 for receiving and securing a second closing strip 82 of closing mechanism 80.

It is important to note that first upper outside wall 31*a* and an upper portion of first inside wall 31*b* above hem enclosure 90 has excess material between first and second upper pouch walls 16, 17 while hem enclosure 90 does not. Likewise, second upper outside wall 32*a* and an upper portion of second inside wall 32*b* above hem enclosure 92 has excess material between first and second upper pouch walls 16, 17 while hem enclosure 92 does not. It should be understood that the side edges of hem enclosures 90, 92 are also attached to first and second upper pouch walls 16, 17. This allows self-closing mechanism 80 to remain in a normally-closed position as shown. Even though FIGS. 4-5 show self-closing mechanism 80 as extending along substantially the distance between first upper pouch edge 16 and second upper pouch edge 17, self-closing mechanism 80 may be only so long as is necessary to allow a user's hand to both access pouch volume 70 and retrieve one or more small parts contained in pouch volume 70. The length of the first and second closing strips 81, 82 defines a secondary access opening 83 (shown in FIGS. 7-8), which is narrower than neck opening 62. It is the self-closing mechanism 80 that prevents the small parts contained in pouch volume 70 of pouch 10 from falling out of pouch 10 when pouch 10 is turned upside down or to the horizontal position, inadvertently or purposely.

Turning now to FIG. 6, there is illustrated a cross-sectional view of pouch 10 transverse to pouch front wall 11 and pouch rear wall 12. As is more clearly shown, first lower wall 51, second lower wall 52 and bottom 14 of pouch lower portion 50 defines pouch volume 70 in which small parts are contained. First lower wall 51 and second lower wall 52 converge towards each other from bottom 14 to neck portion 60 defining a neck opening 62. First upper wall 31 and second upper wall 31 extend upwardly from neck opening 62 at a relatively smaller divergent angle. In this embodiment, first upper wall 31 has a first upper outside wall 31*a* and a first upper inside wall 31*b*. As shown, first upper outside wall 31*a* folds in a reverse direction at pouch top opening 18 forming first inside wall 31*b* that extends toward neck opening 62. At a predefined distance below and from pouch top opening 18, first inside wall 31*b* again folds in a reverse direction forming a first hem wall 31*c*. First hem wall 31*c* extends a predefined distance towards pouch top opening 18 to form a hem enclosure 90 for receiving and securing a first closing strip 81 of closing mechanism 80. Likewise, second upper wall 32 has a second upper outside wall 32*a* and a second upper inside wall 32*b*. As shown, second upper outside wall 32*a* folds in a reverse direction at pouch top opening 18 forming second inside wall 32*b* that extends toward neck opening 62. At a predefined distance below and from pouch top opening 18, second inside wall 32*b* again folds in a reverse direction forming a second hem wall 32*c*. Second hem wall 32*c* extends a predefined distance towards pouch top opening 18 to form a hem enclosure 92 for receiving and securing a second closing strip 82 of closing mechanism 80. As viewed in FIG. 6, a neck width is defined as a horizontal distance between first upper outside wall 31 and second upper outside wall 32*b* at neck 60. A neck height is defined by reference 60 in FIG. 6. An upper portion width is defined as a maximum horizontal distance from the first upper outside wall 31*a* to the second upper outside wall 32*a*. An upper pouch portion height is defined as a length between the neck portion 60 and a top of pouch opening 18. A lower portion width is defined as a maximum horizontal distance from the first lower wall 51 to the second lower wall 52. A lower pouch height is defined as a length between neck portion 60 and bottom 14.

Figure 9:
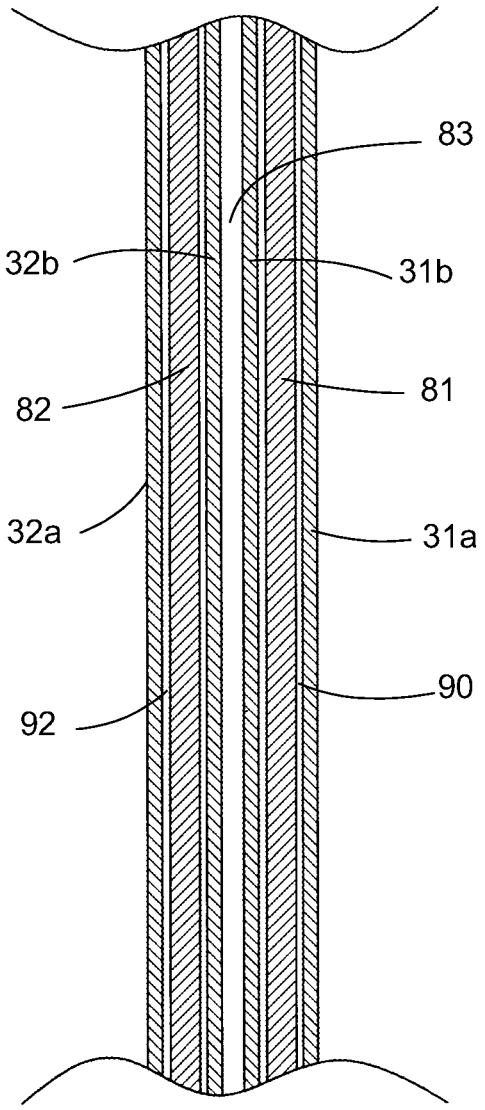
FIG. 9 is a partial, enlarged, cross-sectional view of the embodiment in FIG. 1 showing the self-closing mechanism between two layers of material in its normally-closed orientation.
Figure 10:
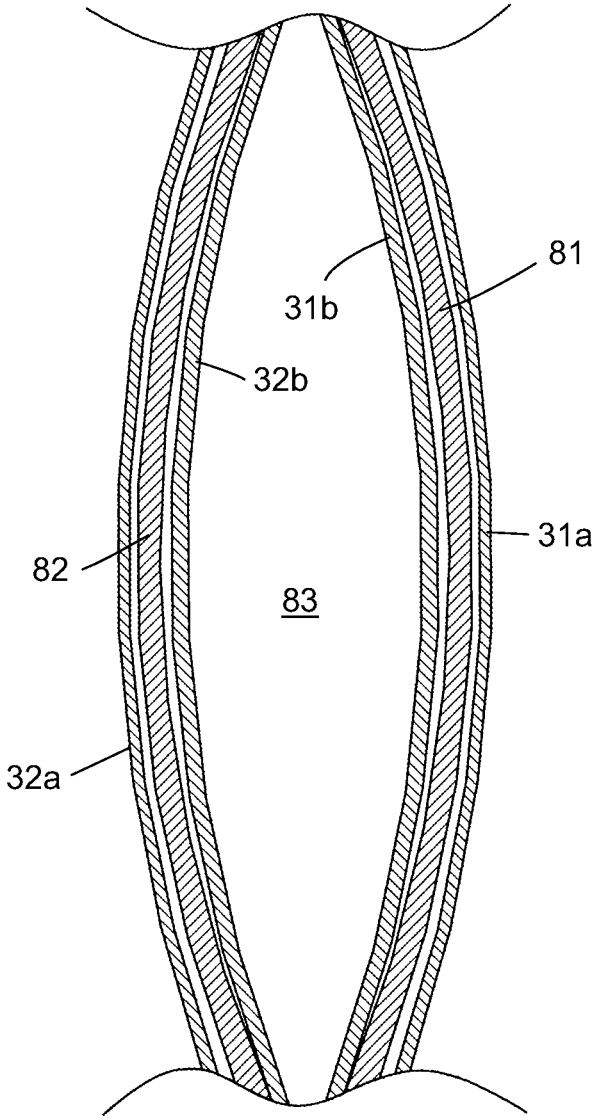
FIG. 10 is a partial, enlarged, cross-sectional view of the embodiment in FIG. 6 showing the self-closing mechanism between two layers of material in a parts space accessing position.

Turning now to FIGS. 9 and 10, there is illustrated an enlarged, partial cross-sectional view of secondary access opening 83 and hems 90, 92. It should be understood that the thickness of the pouch walls 31, 32, the self-closing mechanism 80 and the access opening 83 are exaggerated for ease of understanding the structural relationship of the components to each other. In the normally-closed orientation, the inside pouch walls 31*b*, 32*b* at access opening 83 would be in contact with each other or have such a small spacing that the small parts within pouch volume 70 could not inadvertently fall out and/or pass through access opening 83. FIG. 10 shows access opening 83 in an open orientation when a user's hand (not shown) has forcibly opened (i.e. separated self-closing strips 81, 82 from each other) access opening 83. Typically, a user's fingers would begin penetration through self-closing mechanism 80 forcing self-closing strips 81, 82 to separate allowing the user's hand to follow into pouch volume 70. Because self-closing strips 81, 82 are biased to return to their straight orientation, as soon as the user removes the user's hand from pouch volume 70, self-closing strips 81, 82 return to their original orientation causing access opening to also return to its normally-closed orientation.

Figure 11:
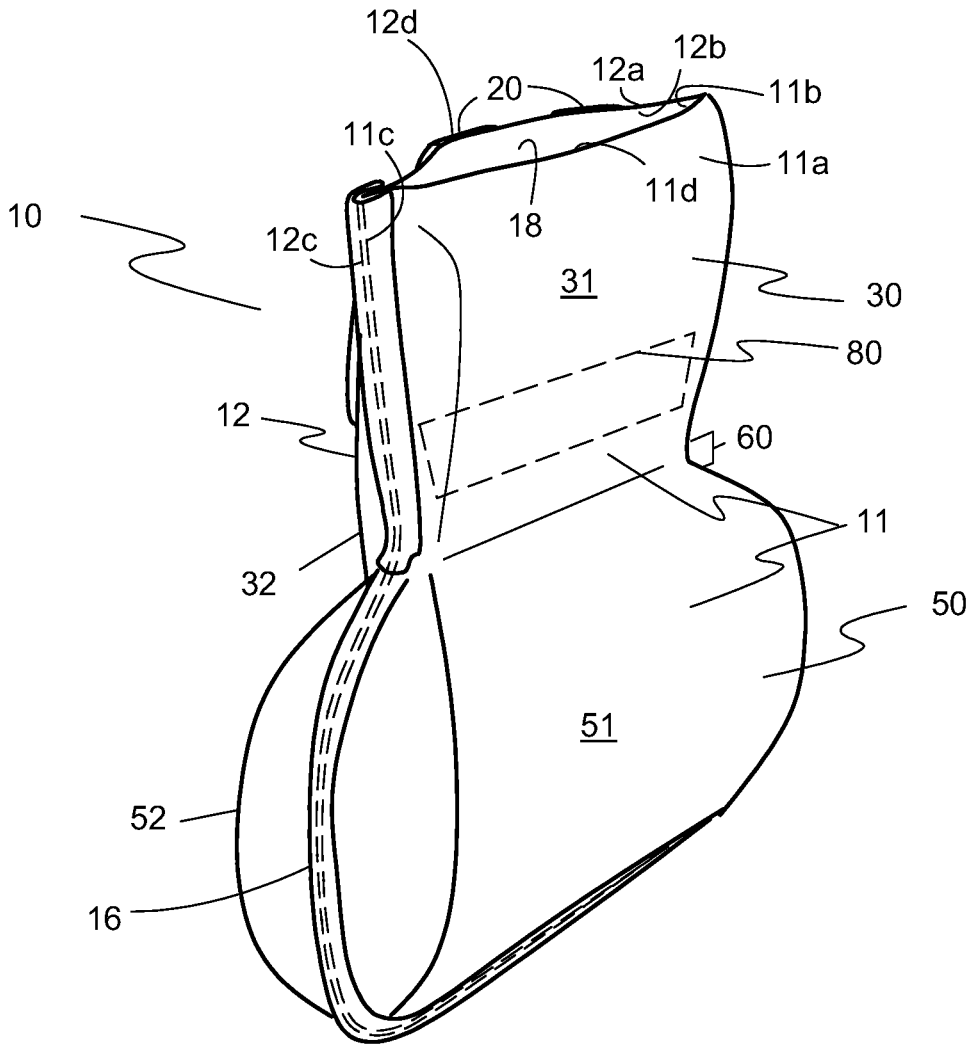
FIG. 11 is a front perspective view of another embodiment of the present invention showing a self-closing pouch without a separately defined bottom component.

Turning now to FIG. 11, there is illustrated another embodiment of self-closing pouch. In this embodiment, self-closing pouch has no separately-defined bottom component. Pouch 10 has an enclosure 10 defining an inside space 70 (not shown) where enclosure 10 has a front side panel 11, a rear side panel 12, an upper portion 30, a lower portion 50 where upper and lower portions 30, 50 are formed by front and rear side panels 11, 12, a top opening 18, a neck portion 60 formed between upper and lower portions 30, 50, and a self-closing mechanism 80. Front side panel 11 has a front inside surface 11*a*, a front outside surface 11*b*, a front peripheral edge 11*c*, and a front opening edge 11*d*. Rear side panel 12 as a rear inside surface 12*a*, a rear outside surface 12*b*, a rear peripheral edge 12*c*, and a rear opening edge 12*d*. Front and rear peripheral edges 11*c*, 12*c* form a first enclosure side edge 16 and a second enclosure side edge 17 (not shown). The front side panel 11 and the rear side panel 12 further define the upper and lower portions 30, 50 where upper portion 30 includes a top opening 18. Top opening 18 is formed and defined by front and rear opening edges 11*d*, 12*d*.

As shown, excess material is used to form lower portion walls 51, 52, which are attached to each other along their peripheries such that a pouch seam 15 is formed from pouch side edge 16 beginning at pouch top opening 18 around pouch lower portion 50 to pouch side edge 17 ending at pouch top opening 18. As in the embodiment shown in FIGS. 1 and 2, self-closing mechanism 80 is contained within pouch upper portion 30.

Although the preferred embodiments of the present invention have been described herein, the above description is merely illustrative. Further modification of the invention herein disclosed will occur to those skilled in the respective arts and all such modifications are deemed to be within the scope of the invention as defined by the appended claims.

What is claimed is:

1. A self-closing utility bag for holding small articles, the bag comprising:

an upper portion having a first upper pouch edge, a second upper pouch edge, a first upper pouch wall and a second upper pouch wall defining a pouch top opening wherein the pouch top opening is partially/slightly open to provide access using only one hand of a user, wherein the upper portion defines an upper pouch length between the first upper pouch edge and the second upper pouch edge;

a lower portion having a first lower pouch edge, a second lower pouch edge, a first lower pouch wall and a second lower pouch wall defining a pouch volume, wherein the first upper pouch wall and the first lower pouch wall form a pouch front wall and wherein the second upper pouch wall and the second lower pouch wall form a rear wall, wherein the lower portion defines a lower pouch length between the first lower pouch edge and the second lower pouch edge;

a neck portion formed by the first upper pouch edge and the second upper pouch edge converging toward each other from the pouch top opening to the neck portion and the first lower pouch edge and the second lower pouch edge diverging away from each other from the neck portion toward a bottom of the lower portion, wherein the neck portion defines a neck length that is smaller than the lower pouch length and the upper pouch length; and a self-closing mechanism located within the upper portion above the pouch volume and spaced a predefined distance from the pouch top opening, the self-closing mechanism having a first resilient strip contacting the first upper pouch wall and extending substantially parallel to the pouch top opening, and entirely disposed above the neck portion, between the neck portion and the pouch top opening and a second resilient strip contacting the second upper pouch wall and extending opposite and parallel the first resilient strip, and substantially parallel to the pouch top opening, and entirely disposed above the neck portion, between the neck portion and the pouch top opening;

wherein the self-closing mechanism defines a secondary access opening to the pouch volume.

2. The utility bag of claim 1 further comprising a protective liner disposed on at least a portion of an inside surface of the lower portion.

3. The utility bag of claim 1 wherein the first resilient strip is in contact with the pouch front wall by being disposed within a hem formed on an inside surface of the first upper pouch wall of the upper portion, or directly connected to the pouch front wall.

4. The utility bag of claim 1 wherein the second resilient strip is in contact with the rear wall by being disposed within a hem formed on an inside surface of the second upper pouch wall of the upper portion, or directly connected to the rear wall.

5. The utility bag of claim 1, wherein the first resilient strip extends over a substantial distance between the first upper pouch edge and the second upper pouch edge.

6. The utility bag of claim 1 further comprising a bottom panel in the lower portion between the first lower pouch wall and the second lower pouch wall having a first bottom edge and a second bottom edge.

7. The self-closing utility bag of claim 1, wherein the neck portion defines a neck height, the upper portion defines an upper pouch portion height, and the lower portion defines a lower pouch portion height; wherein the neck height is smaller than the upper pouch portion height and the lower pouch portion height.

8. The self-closing utility bag of claim 1, wherein the neck portion defines a neck width, the upper portion defines an upper pouch portion width, and the lower portion defines a lower portion width; wherein the neck width is smaller than the upper pouch portion width and the lower pouch portion width.

9. A self-closing pouch for small articles comprising:

an enclosure defining an inside space, the enclosure comprising:

a front side panel with a front inside surface, a front outside surface, a front peripheral edge, and a front opening edge forming a front wall;

a rear side panel with a rear inside surface, a rear outside surface, a rear peripheral edge, and a rear opening edge forming a rear wall wherein the front peripheral edge and the rear peripheral edge forms a first enclosure side edge and a second enclosure side edge;

an upper portion defined by the front side panel and the rear side panel, the upper portion defining a pouch top opening wherein the pouch top opening is partially open;

a lower portion defined by the front side panel and the rear side panel having a bottom edge formed by the front peripheral edge being fixedly attached to the rear peripheral edge, the lower portion defining a pouch volume;

a neck portion located between the upper portion and the lower portion, wherein the first enclosure side edge and the second enclosure side edge converge towards each other from the pouch top opening to the neck portion and then diverge away from each other from the neck portion to the lower portion; wherein the neck portion is narrower than both of the upper portion and the lower portion;

a first resilient strip substantially parallel to the neck portion and disposed entirely above the neck portion and within the upper portion of the front side panel but spaced from the pouch top opening; and a second resilient strip substantially parallel to the neck portion and disposed at a location of the rear side panel opposed and parallel to the first resilient strip wherein all of the second resilient strip contacts the rear wall, the first resilient strip and the second resilient strip defining a secondary access opening wherein the secondary access opening is located within the upper portion, the secondary access opening being contiguous with the first enclosure side edge and the second enclosure side edge, the secondary access opening providing access to the pouch volume of the lower portion;

wherein the first resilient strip and the second resilient strip maintain the secondary access opening in a closed orientation but having a resilient spring action that allows intruding access to the pouch volume of the lower portion by using one hand of a user;

wherein excess material between the first enclosure side edge and the second enclosure side edge above the first resilient strip and the second resilient strip, maintains the pouch top opening at least partially open when the first resilient strip and the second resilient strip are in the closed orientation.

10. The pouch of claim 9 further comprising a protective liner disposed on the front inside surface of the front side panel and the rear inside surface of the rear side panel of the lower portion.

11. The pouch of claim 9 wherein the first resilient strip is embedded in the front inside surface of the front side panel.

12. The pouch of claim 9 wherein the second resilient strip is embedded in the rear inside surface of the rear side panel.

13. The pouch of claim 9 wherein the first resilient strip is disposed within a hem formed on the front inside surface of the front side panel.

14. The pouch of claim 9 wherein in the second resilient strip is disposed within a hem formed on the rear inside surface of the rear side panel.

15. The pouch of claim 9 further comprising at least one belt loop attached to the upper portion on the rear outside surface of the rear side panel.

16. The pouch of claim 10 wherein the first resilient strip extends over a substantial distance between the first enclosure side edge and the second enclosure side edge.

17. The pouch of claim 9 further comprising a bottom panel having a first bottom edge and a second bottom edge, the bottom panel disposed between the front side panel and the rear side panel wherein the first bottom edge is fixedly attached to the front peripheral edge and the second bottom edge is fixedly attached to the rear peripheral edge.

18. The self-closing pouch of claim 9, wherein the neck portion defines a neck height, the upper portion defines an upper pouch portion height, and the lower portion defines a lower pouch portion height; wherein the neck height is smaller than the upper pouch portion height and the lower pouch portion height.

19. The self-closing pouch of claim 9, wherein the neck portion defines a neck width, the upper portion defines an upper pouch portion width, and the lower portion defines a lower pouch portion width; wherein the neck width is smaller than the upper pouch portion width and the lower pouch portion width.

20. A self-closing utility bag for holding small articles, the bag comprising:

an upper pouch portion having:

a first upper wall and a second upper wall forming a pouch top opening having an opening length between a first side edge and a second side edge opposite the first side edge, the pouch top opening being partially open to provide access by a user's hand;

a first resilient strip contacting the first upper wall substantially parallel to the pouch top opening, disposed below the pouch top opening, and having a first strip length;

a second resilient strip contacting the second upper wall opposite the first resilient strip, substantially parallel to the pouch top opening, disposed below the pouch top opening, and having a second strip length;

a neck portion, positioned entirely below the upper pouch portion, the neck portion having a length between a first neck edge and a second neck edge that is shorter than the opening length of the pouch top opening; and a lower pouch portion, below the neck portion, and having a pouch volume:

a first lower pouch wall and a second lower pouch wall extending between the first side edge and the second side edge wherein the pouch volume has a length between the first side edge and the second side edge that is greater than the length of the neck portion;

wherein the neck portion is formed by the first side edge and the second side edge converging toward each other from the pouch top opening to the neck portion and the first side edge and the second side edge diverging away from each other from the neck portion toward a bottom of the lower portion;

wherein the first resilient strip and the second resilient strip define a secondary access opening located entirely above the neck portion, the secondary access opening being in a closed orientation but adapted to allow use of a single hand of a user to open and access contents of the pouch volume.

21. The self-closing utility bag of claim 20, wherein the neck portion defines a neck height, the upper pouch portion defines an upper pouch portion height, and the lower pouch portion defines a lower pouch portion height; wherein the neck height is smaller than the upper pouch portion height and the lower pouch portion height.

22. The self-closing utility bag of claim 20, wherein the neck portion defines a neck width, the upper pouch portion defines an upper pouch portion width, and the lower pouch portion defines a lower pouch portion width; wherein the neck width is smaller than the upper pouch portion width and the lower pouch portion width.

* * * * *